US009157691B2

(12) United States Patent
Parnell

(10) Patent No.: US 9,157,691 B2
(45) Date of Patent: Oct. 13, 2015

(54) APPARATUS AND METHOD FOR ACTUATING A SLIDE MECHANISM FOR A SEMI-AUTOMATIC PISTOL

(71) Applicant: John E Parnell, Easley, SC (US)

(72) Inventor: John E Parnell, Easley, SC (US)

(73) Assignee: P.U.F., LLC, Pickens, SC (US)

( * ) Notice: Subject to any disclaimer, the term of this patent is extended or adjusted under 35 U.S.C. 154(b) by 0 days.

(21) Appl. No.: 14/583,906

(22) Filed: Dec. 29, 2014

(65) Prior Publication Data

US 2015/0184959 A1 Jul. 2, 2015

Related U.S. Application Data

(60) Provisional application No. 61/922,295, filed on Dec. 31, 2013.

(51) Int. Cl.

| | |
|---|---|
| ***F41A 7/00*** | (2006.01) |
| ***F41A 35/00*** | (2006.01) |
| ***F41A 3/72*** | (2006.01) |

(52) U.S. Cl.
CPC ... *F41A 3/72* (2013.01); *F41A 7/00* (2013.01); *F41A 35/00* (2013.01)

(58) Field of Classification Search
CPC ..... F41A 7/00; F41A 99/00; F41A 11/00; F41A 35/00; F41C 27/00; F41C 33/0281
USPC ..... 42/85, 90, 106, 108; 89/1.4
See application file for complete search history.

(56) References Cited

U.S. PATENT DOCUMENTS

| | | | | |
|---|---|---|---|---|
| 4,043,065 | A * | 8/1977 | Musgrave | 42/106 |
| 4,138,044 | A * | 2/1979 | Musgrave | 224/242 |
| 4,298,150 | A * | 11/1981 | Seldeen | 224/243 |
| 4,823,671 | A * | 4/1989 | Buryta | 89/1.4 |
| 5,275,084 | A * | 1/1994 | Ruger | 89/196 |
| 2006/0053674 | A1* | 3/2006 | Shober | 42/108 |
| 2010/0170923 | A1* | 7/2010 | Abushaev | 224/243 |
| 2011/0088539 | A1* | 4/2011 | Oz | 89/1.4 |
| 2012/0198744 | A1* | 8/2012 | Meller et al. | 42/90 |
| 2013/0180152 | A1* | 7/2013 | Speroni | 42/99 |
| 2013/0255478 | A1* | 10/2013 | McAninch | 89/1.4 |
| 2014/0298703 | A1* | 10/2014 | Gale et al. | 42/71.02 |
| 2015/0020428 | A1* | 1/2015 | Jenkinson | 42/108 |

* cited by examiner

*Primary Examiner* — Bret Hayes
*Assistant Examiner* — Derrick Morgan
(74) *Attorney, Agent, or Firm* — Trego, Hines & Ladenheim, PLLC

(57) ABSTRACT

An apparatus configured to aid a user in actuating a slide mechanism of a semi-automatic pistol is disclosed. The apparatus includes a first side portion connected to a second side portion by a top portion extending therebetween, a tunnel configured to receive the slide mechanism therein and extend a length of the apparatus from a first end portion to a second end portion, and a flange configured to rest against an end of the slide mechanism to provide a pushing force on the end when a user actuates the slide mechanism.

12 Claims, 3 Drawing Sheets

APPARATUS AND METHOD FOR ACTUATING A SLIDE MECHANISM FOR A SEMI-AUTOMATIC PISTOL

BACKGROUND OF THE INVENTION

This invention relates generally to firearms and more particularly to an apparatus and method for actuating a slide of a semi-automatic pistol.

Firearms come in many types and sizes with each being utilized for specific tasks. One example of a firearm is a handgun. Handguns are typically used by law enforcement as well as non-law enforcement individuals for self-defense and/or target practice due to the size and ease of carry. Handguns come in single-shot, revolver, and semi-automatic configurations. While single-shot and revolver type handguns are relatively easy to operate, some semi-automatic configurations can be difficult due to the type of action utilized.

Semi-automatic pistols use a slide mechanism to "cock" or load the pistol with ammunition in its chamber. The slide mechanism is spring-loaded and requires a user to grasp the slide mechanism and actuate or pull/push backward towards the user. As the slide mechanism is pulled back, ammunition is removed from a magazine and loaded into the chamber. Additionally, pulling the slide mechanism also sets the firing pin to allow a user to pull a trigger and strike the ammunition, thereby causing a projectile of the ammunition to speed down a barrel of the pistol, exit the barrel, and enter a target. In the case of a jam or malfunction, pulling the slide mechanism can aid in ejecting the jammed ammunition out an ejection port of the semi-automatic pistol.

The slide mechanism of semi-automatic pistols can often be difficult to actuate due to many factors. For example, the slide mechanism may have a smooth finish that is difficult to grip, may be too narrow to provide a user with enough surface area to grip, may have a stiff spring that makes it difficult to slide, and/or any combination of factors. As a result, users often struggle with loading ammunition into a chamber of a semi-automatic pistol. This becomes especially troublesome when users use the semi-automatic pistol for personal protection and time is of the essence.

Accordingly, there remains a need for an apparatus and method that permits a user to actuate a slide mechanism of a semi-auto pistol quickly and easily.

BRIEF SUMMARY OF THE INVENTION

This need is addressed by the present invention, which provides an apparatus configured to aid a user in actuating a slide mechanism of a semi-automatic pistol.

According to one aspect of the invention, an apparatus configured to aid a user in actuating a slide mechanism of a semi-automatic pistol includes a first side portion connected to a second side portion by a top portion extending therebetween, a tunnel configured to receive the slide mechanism therein and extend a length of the apparatus from a first end portion to a second end portion, and a flange configured to rest against an end of the slide mechanism to provide a pushing force on the end when a user actuates the slide mechanism.

According to another aspect of the invention, a method of actuating a slide-mechanism of a semi-automatic pistol includes the step of providing an apparatus having a first side portion, a second side portion, and a flange. The method further includes the steps of positioning the apparatus over the slide mechanism of the semi-automatic pistol such that the flange is adjacent to an end of the slide mechanism, gripping the first and second side portions, and actuating the slide mechanism.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
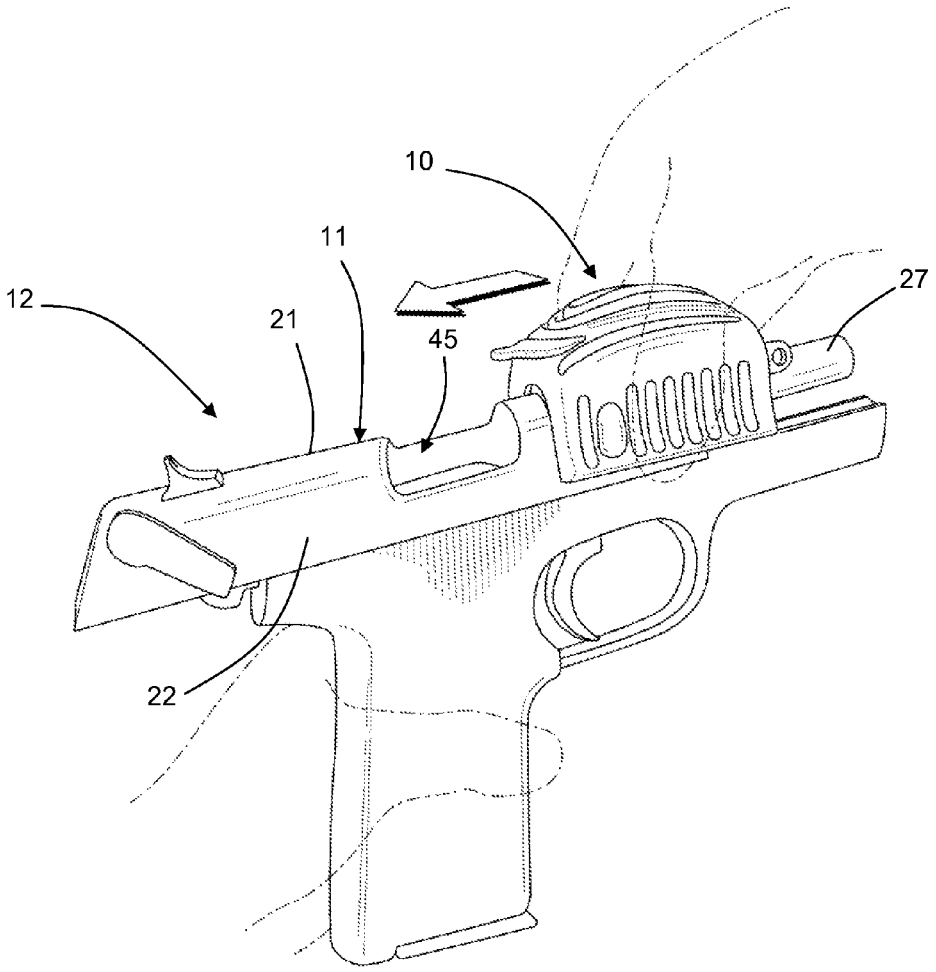
FIG. 1 illustrates an apparatus according to an embodiment of the invention being used to actuate a slide mechanism of a semi-automatic pistol.

Referring to the drawings wherein identical reference numerals denote the same elements throughout the various views, FIG. 1 illustrates an apparatus according to an embodiment of the invention and is shown generally at reference numeral 10. The apparatus 10 provides an ergonomic solution to actuating a slide-mechanism 11 of a semi-automatic pistol 12. The apparatus 10 is adjustable to fit different sized pistols, i.e., longer, shorter, wider, and/or narrower and allows a user to force the slide mechanism back to allow ammunition to enter a chamber of the pistol 12 and/or eject ammunition out an ejection port 45.

Figure 2:
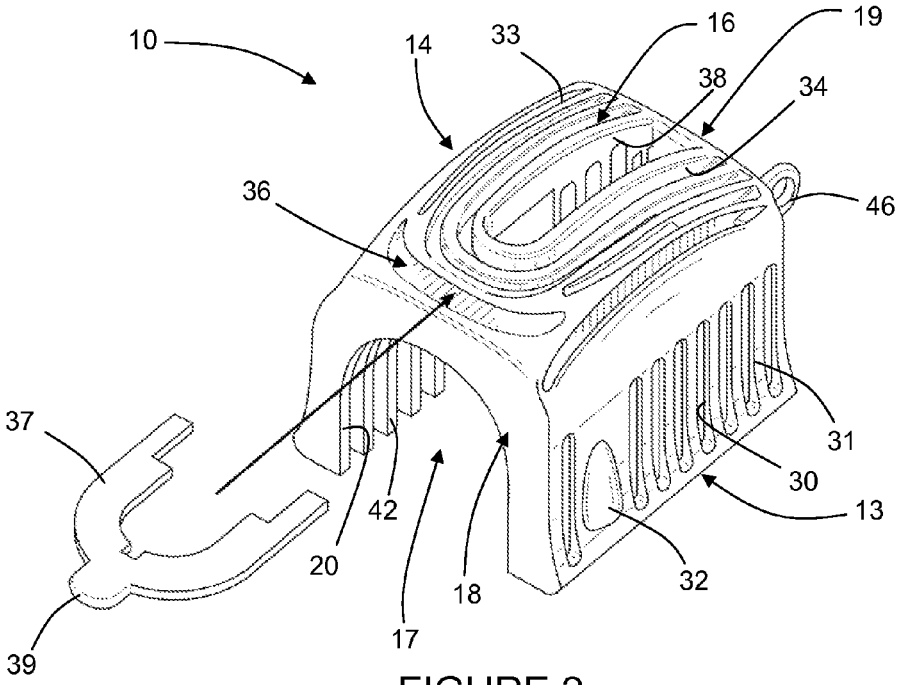
FIG. 2 is a top perspective view of the apparatus of FIG. 1.
Figure 3:
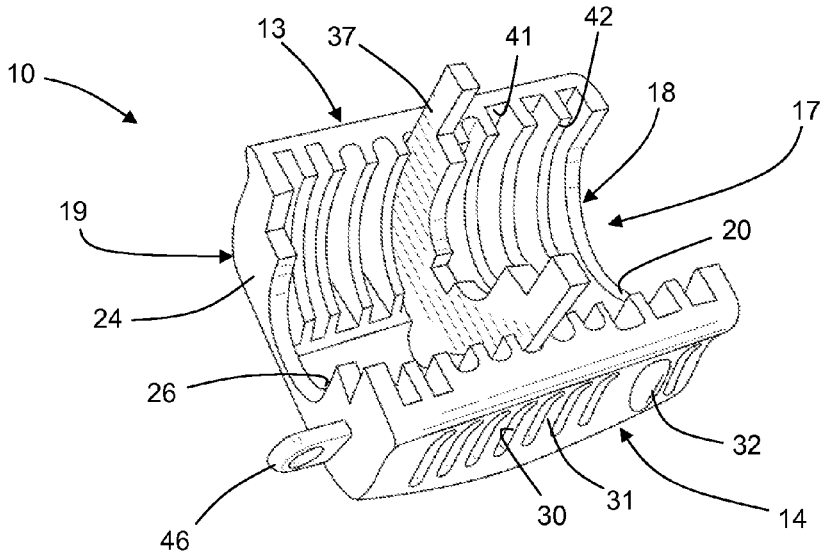
FIG. 3 is a bottom perspective view of the apparatus of FIG. 1.

As illustrated in FIGS. 2 and 3, the apparatus 10 includes a first side portion 13 connected to a second side portion 14 by a top portion 16 extending therebetween. A tunnel 17 extends a length of the apparatus 10 from a first end portion 18 to a second end portion 19. As shown, the tunnel 17 has a generally U-shaped profile and extends through the first end portion 18, creating an opening 20 therein, to permit the apparatus 10 to slide over slide mechanism 11 such that top portion 16 is adjacent to a top 21 of the slide mechanism 11, first side portion 13 is adjacent to a first side 22 of the slide mechanism 11, and second side portion 14 is adjacent to a second side 23 of the slide mechanism 11.

Figure 4:
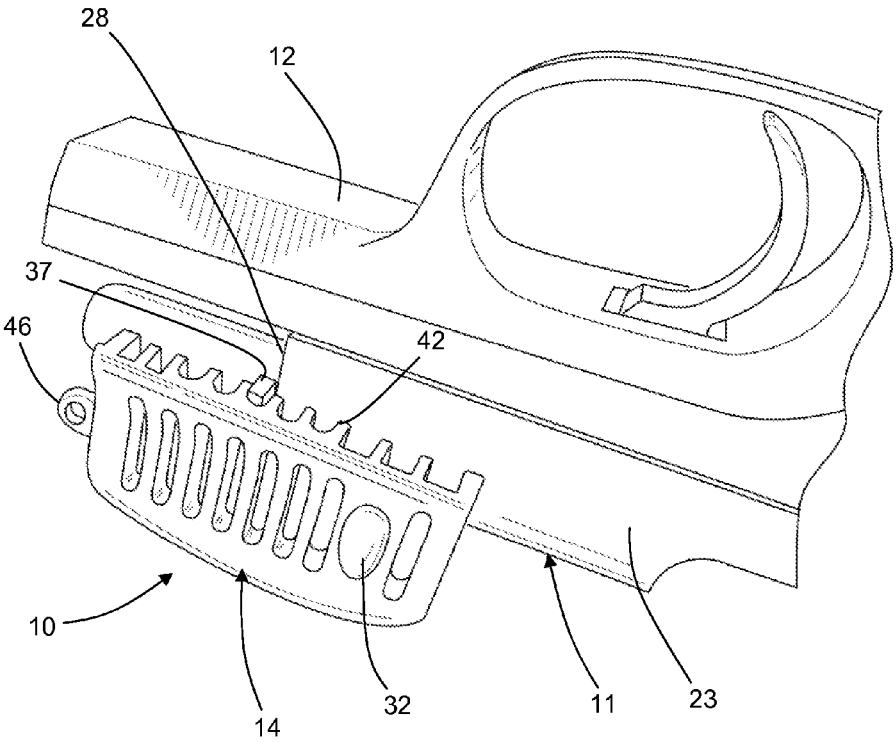
FIG. 4 illustrates the apparatus of FIG. 2 being used to actuate the slide mechanism of the semi-automatic pistol of FIG. 1.

Second end portion 19 forms a flange 24 having an opening 26 suitable to allow a barrel 27 of the semi-automatic pistol 12 to extend therethrough when the slide mechanism 11 is actuated. The flange 24 rests against an end 28 of the slide mechanism 11, shown in FIG. 4, to push the slide mechanism 11 during actuation and aid a user in actuating the slide mechanism 11. A lanyard connector 46 is connected to the second side portion 19 to permit a user to carry the apparatus 10 using a lanyard or other suitable carry device.

The first and second side portions 13 and 14 each include a plurality of apertures 30 which aid a user in actuating the slide mechanism 11. The apertures 30 create ridges 31 to provide additional grip to the user. Additionally, a knob 32 is positioned on each of the first and second side portions 13 and 14 to provide a user with additional grip when actuating. The knob 32 is positioned proximate the first end portion 18 for stability and to provide a user with maximum pushing ability, see FIG. 1.

The top portion 16 includes a plurality of ridges 33 separated by grooves 34 extending through the top portion 16. The grooves 34 allow the top portion 16 to be flexible so that a user may squeeze the first and second side portions 13 and 14 against the slide mechanism 11, causing the top portion 16 to collapse and, thereby permitting the first and second side portions 13 and 14 to provide a uniform clamping force to the first and second sides 22 and 23 of the slide mechanism 11. A storage compartment 36 is positioned on the top portion and allows an insert 37 to be stored therein, FIG. 2. Additionally, the top portion 16 includes an aperture 38 extending therethrough. The aperture 38 permits a sight (not shown) positioned on the top 21 of the slide mechanism 11 or a top 39 of the insert 37 to protrude therethrough.

As illustrated in FIG. 3, an underside 40 of the apparatus 10 includes a plurality of slots 41. The slots 41 are configured to receive the insert 37 therein to allow the apparatus 10 to be adjusted for barrels of different lengths. The slots 41 also create ridges 42 that provide additional gripping forces on the sides 22 and 23. As shown, the insert 37 is configured to act as a flange, like second end portion 19. The insert 37 allows the apparatus 10 to be used on semi-automatic pistols that have a short barrel, FIG. 4. This is especially important when trying to remove jammed ammunition from a chamber of the semi-automatic pistol 12 because the insert 37 prevents the apparatus 10 from covering the ejection port 45 of the semi-automatic pistol 12, thereby allowing the jammed ammunition to be expelled from the chamber out the ejection port 45.

In use, a user places the apparatus 10 over the slide mechanism 11 such that slide mechanism 11 resides in the tunnel 17 and the flange 24 of the second end portion 19 rests against end 28 of the slide mechanism 11, thereby permitting the first and second side portions 13 and 14 to be positioned adjacent to sides 22 and 23. In the case where insert 37 is used, the insert 37 is secured in a selected slot 41 such that when the apparatus 10 is placed over the slide mechanism 11, the insert 37 rests against the end 28.

Once the apparatus 10 is positioned over the slide mechanism 11, the user grips first and second side portions 13 and 14, as shown in FIG. 1, and actuates the slide mechanism back towards the user or back towards a rear of the semi-automatic pistol 12. As illustrated, the ridges 31 and knobs 32 provide the user with gripping mechanisms to aid in the actuation. As the user begins to actuate the slide mechanism 11, the flange 24 or insert 37 (if used) push against the end 28 to aid the user in actuating the slide mechanism 11. In addition to the flange 24 pushing against the end 28, the user may also squeeze first and second side portions 13 and 14, thereby causing the side portions 13, 14 to clamp against the first and second sides 22, 23, to provide the user with additional help in actuating the slide mechanism 11.

The foregoing has described an apparatus and method for actuating a slide of a semi-automatic pistol. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. An apparatus configured to aid a user in actuating a slide mechanism of a semi-automatic pistol, comprising:

(a) a first side portion connected to a second side portion by a top portion extending therebetween;

(b) a tunnel extending a length of the apparatus from a first end portion to a second end portion, the tunnel being configured to receive the slide mechanism therein;

(c) a plurality of slots spaced along the length of the apparatus; and (d) an insert configured to be received in a selected one of the slots so as to define a first flange configured to rest against an end of the slide mechanism to provide a pushing force on the end when a user actuates the slide mechanism, such that movement of the insert from one slot to another allows the user to adjust the apparatus for use with semi-automatic pistols of varying length.

2. The apparatus according to claim 1, wherein the first side portion includes a knob to aid a user in actuating the slide mechanism.

3. The apparatus according to claim 1, wherein the second side portion includes a knob to aid a user in actuating the slide mechanism.

4. The apparatus according to claim 1, further comprising a second flange disposed in the second end portion and configured to rest against an end of the slide mechanism to provide a pushing force on the end when a user actuates the slide mechanism.

5. The apparatus according to claim 1, wherein the first flange includes an opening configured to receive and allow a barrel of the semi-automatic pistol to extend therethrough.

6. The apparatus according to claim 1, wherein the top portion includes a storage compartment configured to store an insert therein.

7. The apparatus according to claim 1, wherein the first and second side portions each include a plurality of ridges configured to aid a user in actuating the slide mechanism.

8. The apparatus according to claim 1, further including a connector positioned on the second end portion to permit a user to connect a carrying device thereto.

9. The apparatus according to claim 1, wherein the top portion further includes a plurality of grooves to permit the top portion to collapse and allow a user to squeeze the first and second side portions against the first and second sides of the slide mechanism, thereby permitting the first and second side portions to provide a uniform clamping force against the first and second sides.

10. A method of actuating a slide-mechanism of a semi-automatic pistol, comprising the steps of:

(a) providing an apparatus having:

(i) a first side portion;

(ii) a second side portion; and (iii) a flange configured to exert a pushing force against an end of a slide mechanism of an automatic pistol;

(b) adjusting a useable length of the apparatus by positioning the flange in a pre-determined one of a plurality of slots of the apparatus such that the apparatus does not interfere with an ejection port of the semi-automatic pistol;

(c) positioning the apparatus over the slide mechanism of the semi-automatic pistol such that the flange is adjacent to an end of the slide mechanism;

(d) gripping the first and second side portions; and (e) actuating the slide mechanism.

11. The method according to claim 10, further including the step of squeezing the first and second side portions against the first and second sides of the slide mechanism to clamp the apparatus against the sides of the slide mechanism and aid the user in actuating the slide mechanism.

12. The apparatus according to claim 1, wherein the second flange includes an opening configured to receive an allow a barrel of the semi-automatic pistol to extend therethrough.

* * * * *